United States Patent [19]

Hall

[11] Patent Number: 4,744,466

[45] Date of Patent: May 17, 1988

[54] QUICK OPENING PINCH SEAL BAG

[75] Inventor: Donald E. Hall, Sibley, Iowa

[73] Assignee: Chase Bag Company, Greenwich, Conn.

[21] Appl. No.: 328,733

[22] Filed: Dec. 8, 1981

[51] Int. Cl.[4] ..... B65D 33/16

[52] U.S. Cl. ..... 206/620; 206/604; 206/605; 206/610; 383/66; 383/120

[58] Field of Search ..... 206/620, 622, 626, 628, 206/815, 610, 614, 618, 619, 624, 625, 632; 229/55, 62

[56] References Cited

U.S. PATENT DOCUMENTS

| | | | |
|---|---|---|---|
| 1,869,313 | 7/1932 | Mackay | 206/620 |
| 2,287,893 | 6/1942 | Lundberg | 206/611 |
| 2,593,328 | 4/1952 | Meaker | 229/55 |
| 2,844,298 | 7/1958 | Tamarin | 206/632 |
| 3,168,233 | 2/1965 | Ignell | 206/628 |
| 3,291,374 | 12/1966 | Lepisto et al. | 229/55 |
| 3,497,131 | 2/1970 | Tracy | 206/628 |
| 3,910,488 | 10/1975 | Goodrich | 206/618 |
| 4,197,949 | 4/1980 | Carlsson | 206/625 |

FOREIGN PATENT DOCUMENTS

| | | | |
|---|---|---|---|
| 2035258 | 6/1980 | Fed. Rep. of Germany | 206/620 |

*Primary Examiner*—David T. Fidei

*Attorney, Agent, or Firm*—Jacobs & Jacobs

[57] ABSTRACT

The present invention provides a heavy-duty, multi-wall or multi-ply bag having gusseted sides and overlapping upper sealing edges of the pinch seal type, wherein a quick-opening construction is provided for such bag. The quick-opening construction consists of (a) a slotted portion formed of one or more slots in the outer wall of the bag, within the gusset and adjacent the upper sealed portion of the bag, and (b) a transverse perforated section on the inner wall or walls (plies) of the bag and disposed substantially intermediate the slots in the outer wall. The outer wall may be torn by fingers engaging the slots, and the inner wall or walls may be penetrated by fingers entering the perforations. The entire upper corner of the bag may be hand opened to provide a funnel for quick delivery of the contents.

7 Claims, 3 Drawing Sheets

FIG. 2
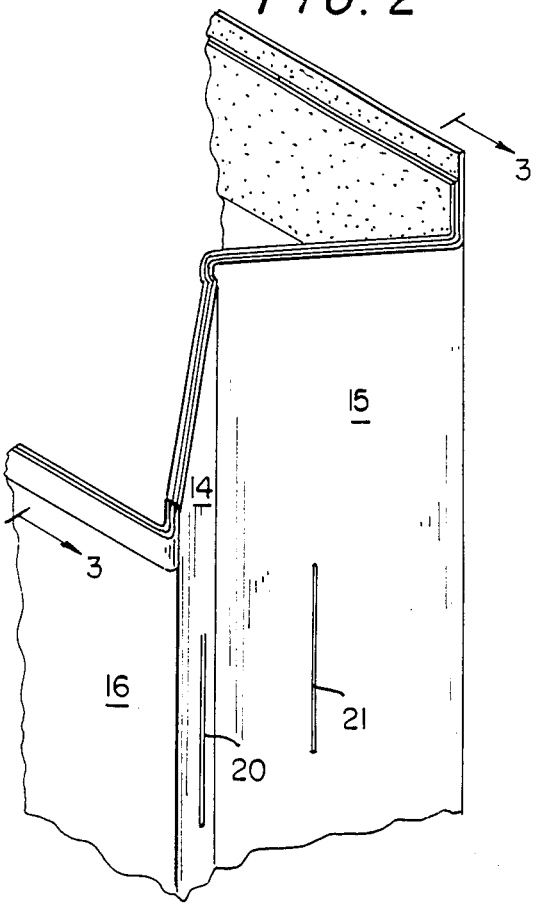
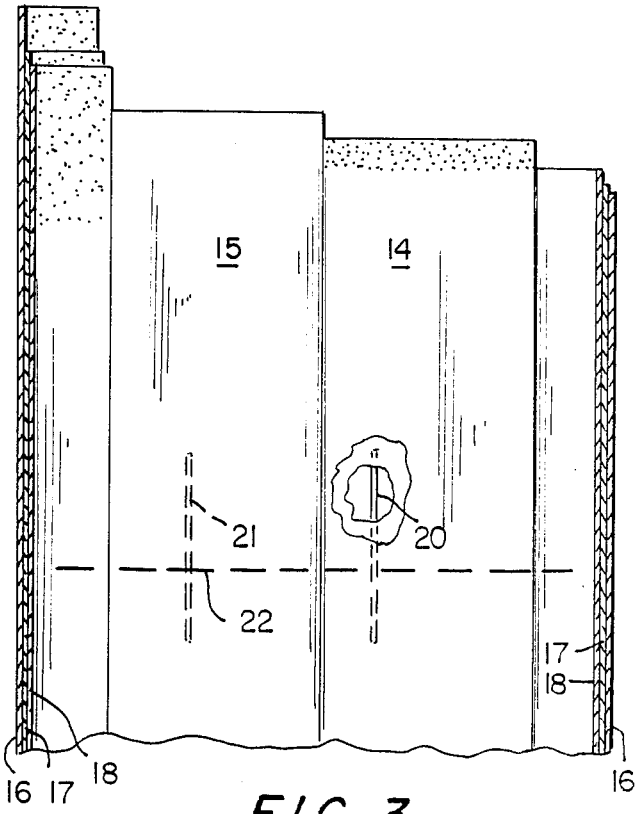
FIG. 3
FIG. 4
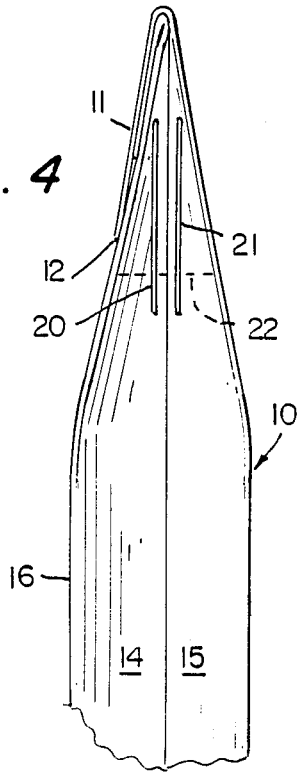
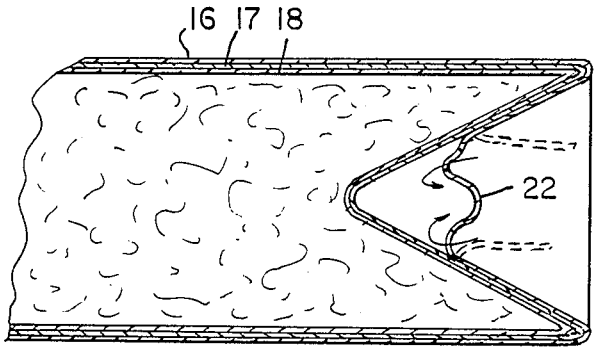
FIG. 5

QUICK OPENING PINCH SEAL BAG

The present invention relates to an improved quick-opening pinch seal, multi-ply bag, of the type used for packaging heavyweight products of about 10 pounds to 50 pounds for trans-shipment from the packaging source to the place of distribution, without damaging the bag or causing loss of product, while at the same time making it easy to open the bag for free flow of its contents after sale to the ultimate user.

More particularly the present invention provides a quick-opening multi-wall or multi-ply bag of the gusseted type wherein the quick-opening structure is provided in the gusset, adjacent the upper pinch-sealed end of the bag, whereat it is subjected to the minimum of internal pressures during storage and trans-shipment, while at the same time lending itself to quick opening by the ultimate purchaser or user of the products packaged in the bag.

BACKGROUND OF THE INVENTION

The present invention relates to multi-wall and multi-ply bags for packaging heavyweight material of various quantities, ranging in weight from 10 pounds to 50 pounds. Such bags usually are composed of at least two plies or layers so as to provide the requisite strength and resistance to moisture, as well as to impact damage during trans-shipment from the place of packaging to the place of sale. Such bags usually are closed at their top and bottom ends by either sewing or pinch sealing, the latter using an overlap with adhesive to close the open top end of the bag. Many multi-ply or multi-wall bags of the type referred to are also gusseted along their side walls to provide for expansion of the bag during filling with the product to be packaged.

One of the problems presented to the user of such heavy-duty gusseted multi-wall or multi-ply bags is the difficulty of opening them to release the contents without completely damaging the bag and its retention capacity for the balance of the contents. It is well known in the art that with heavy-duty multi-wall gusseted bags wherein the bag closure is formed by sewing, it is possible to sew the closure with stitching which lends itself to easy opening. However, such easy-opening feature of bags closed by stitching weakens the bag top closure and gives rise to easy rupture in transit and storage. Also, there are limitations as to the places where such easy-opening stitching can be applied to the bag.

With pinch seal bags, however, where the overlapping layers of each ply are so arranged that they are individually, adhesively secured to each other and pinched by conventional bag closing mechanisms to form an adhesively secured pinch seal, it has not heretofore been possible to provide a quick-opening for such bags because of the inherent and built-in strength of such pinch seal.

It has long been recognized that a multi-ply or multi-wall heavy-duty gusseted pinch seal bag preferably should also be provided with an easy opening structure, if it does not detract from or impair the impact and product retention characteristics of the bag during trans-shipment and rough handling from place of packaging to place of delivery and ultimate place of sale. This has not been possible prior to the present invention.

SUMMARY OF THE INVENTION

The present invention provides a heavy duty, multi-wall or multi-ply bag having gusseted sides and overlapping upper sealing edges, preferably of the pinch seal type, wherein a quick-opening construction is provided for such bag. Essentially the quick-opening construction consists of two fundamental elements; i.e., (a) a slotted portion formed of one or more slots in the outer wall of the bag, within the gusset and adjacent the upper sealed portion of the bag, and (b) a transverse perforated section on the inner wall or walls (plies) of the bag and disposed substantially intermediate the slots in the outer wall, whereby, the upper outer wall may be torn away by fingers engaging said slot or slots, and the inner walls may be torn away by a quick upward hand jerk on the corner, or by fingers penetrating the perforations. In the first instance the entire upper corner of the bag is torn away, and in the second instance a funnel is provided. In both instances the contents of the bag may be poured from the bag, without the retention characteristics of the bag being destroyed.

PRIOR ART

Applicant is unaware of any prior art patents or publications which remotely relate to the invention here sought to be protected. A preliminary search was conducted and the classes searched were as follows:

Class 206: Subclass 620, 622, 626, 628
Class 229: Subclass 53, 55, 62, 81
Class 493: Subclass 212, 923

DETAILED DESCRIPTION OF THE INVENTION

For a more detailed description of the present invention, reference will now be made to the accompanying drawings, wherein:

FIG. 1. is a fragmentary perspective view, showing the upper half of a quick-opening, pinch-sealed, gusseted, multi-wall bag constructed in accordance with the present invention;

FIG. 2 is a fragmentary view of one upper corner of the bag shown in FIG. 1, prior to closing and pinch sealing;

FIG. 3 is a view of the bag section shown in FIG. 2, taken along the line 3—3, when viewed in the direction of the arrows, with certain underlying structure shown in full view;

FIG. 4 is a fragmentary side elevation of the bag shown in FIG. 1;

FIG. 5 is a fragmentary sectional view showing the perforated area of the upper gusseted area, prior to quick opening;

Figure 1:
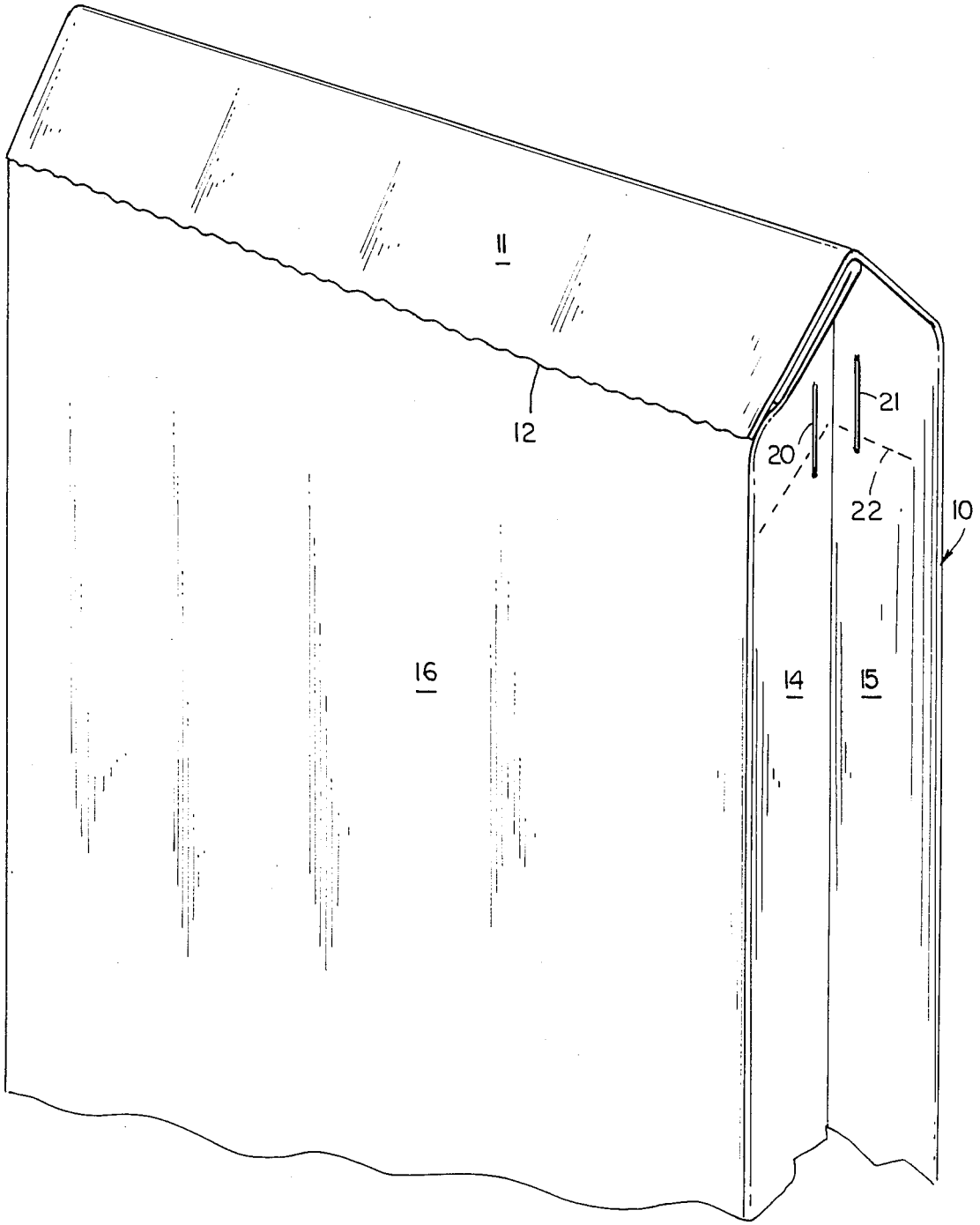

Referring now to the drawings for a more detailed explanation of the invention, the upper half of a multi-ply bag 10 is shown in perspective in FIG. 1, such bag being of the pinch-seal type which after filling is closed along the top wall 11 by adhesive previously applied to the ply sections and then heat sealed in overlapping relationship by a pinch-sealing machine to form the upper wall 11 with its edge join 12. The bag 10 is also of the gusseted type as shown in FIG. 1 with inwardly directed gusseted walls 14, 15, the gusset allowing for expansion of the bag during filling to accommodate the quantity of merchandise to be packaged therein. Such multi-wall gusseted bags are usually used for packaging between 10 and 50 pounds of dry material such as seeds, soybeans and the like.

Heretofore it has been difficult to open such pinch-seal, multi-wall bags in a convenient and easy manner as there has not heretofore been provided any quick opening means for such bags, as contrasted with multi-wall bags which are closed by sewing, with such sewing being so done as to provide a thread line at one of the upper corners of the bag to permit it to be ripped open along a section of the top.

With all multi-wall bags for packaging heavy-weight material, shipping the same and storing the same in stacks until sale to the ultimate consumer or user, it is essential that such bags not have any point of weakness which might rupture and hence spill the contents during shipment and storage.

The bag shown in the drawings is a three-ply bag having an outer ply or layer 16 of heavy paper to which the trademark, logo and other printed matter of the distributor can be applied. The two inner layers or plies preferably are of moisture-resistant or foil material which are only sealed to the outer ply along the top and bottom ends of the bag.

The important contribution of the present invention which provides for quick opening of the pinch seal multi-ply bag is the provision of two vertical slots 20, 21 in the outer ply of the bag in the gusseted portion at one side of the bag near its upper end, and perforations 22 in the two inner plies of the multi-ply bag, such perforations being disposed substantially mid-point of such vertical slots 20, 21.

Figure 6:
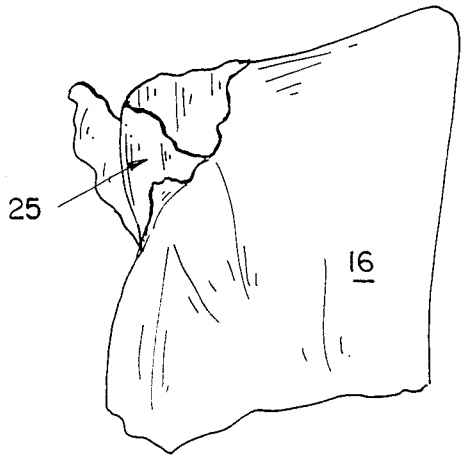
FIG. 6 is a fragmentary, perspective view of the upper corner of the bag provided by the present invention, after it has been quick-opened.
Figure 7:
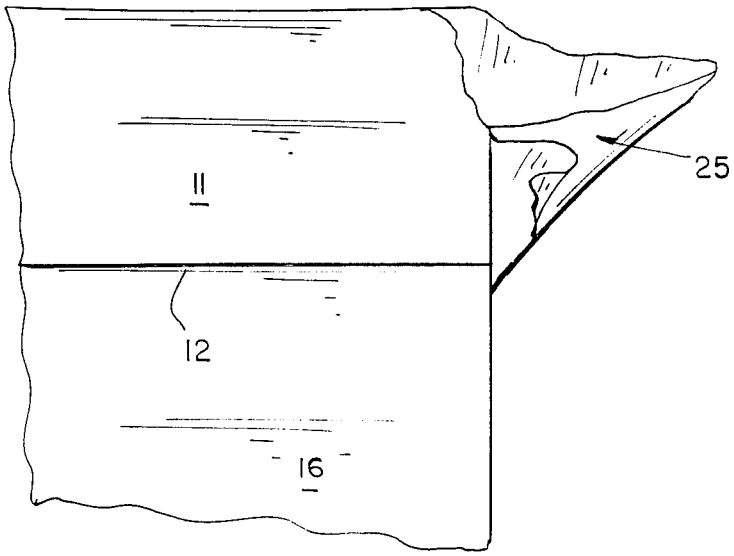
FIG. 7 is a fragmentary, front elevational view of the bag shown in FIG. 6 and which shows the pouring spout resulting from quick opening according to the present invention.

According to the present invention for quick opening of the pinch seal multi-ply bag the fingers of the consumer are inserted into the gusset of one of the side walls of the bag through the vertical slots 20, 21 adjacent the upper end of such gusset to tear away the outer ply of the bag at its upper end. Then, by grasping the upper corner of the bag it is possible by a series of jerks to open the upper corner of the bag to the condition shown in FIG. 6, and to provide a pouring spout 25 as shown in both FIGS. 6 and 7.

In the alternative it is also possible to open the bag by first tearing away the outer ply along slots 20, 21, and then inserting the hand of the user through the perforations 22 in the inner plies to tear the upper corner of the bag and to provide a pouring spout 25.

As earlier pointed out, with pinch seal gusseted bags for packaging, shipping and storing heavyweight dry material between 10 and 50 pounds, it is important that any quick-opening device not rupture or cause spillage during packaging, trans-shipment and storage.

The following tests were run by applicant or under his supervision with the following results:

In tests which were conducted with bags 14 inches×3½ inches×34 inches, of three-ply construction of 60# Nat. Ext./60# Nat. Ext./60# Wh. Ribbed Ext., the easy opening structure was located in a gusset two inches down from the closure end of the pinch seal bag.

Vibration and drop tests were run to evaluate any problems with sifting of product within the bag, or loss of strength of the bag in the quick-opening area. The vibration tests showed no problem with sifting of the products between the plies or to the outside of the bag. On the drop tests the bags averaged eleven drops using a six-drop cycle starting at two feet. There was no indication that the quick-opening area affected the performance of the bags. On the contrary, it was shown that the unique location of the slots and perforated area in the upper end of the gusset, which is the low stress area of the bag, allows for quick opening according to the present invention without yielding to stresses strong enough to break the bag in other areas.

What I claim is:

1. A multi-wall, heavy-duty bag having an outer ply, at least one inner ply, gusseted side walls, and an adhesive closure for each end of the bag, characterized in that said bag has:

(a) a slot in the outer ply of one of said gusseted side walls adjacent a said closure, and (b) transverse perforations in the inner ply of said one gusseted side wall adjacent said slot, whereby said bag may be quickly opened by tearing the outer ply adjacent said slot, and penetrating the inner ply through said transverse perforations.

2. A multi-wall, heavy-duty bag according to claim 1, wherein at least two vertical slots are provided in said outer ply of said one gusseted side wall of the bag, and the transverse perforations are provided on the inner ply adjacent said slots.

3. A multi-wall, heavy-duty, pinch-seal bag having an outer ply, at least one inner ply, gusseted side walls, and an adhesive closure for each end of the bag, characterized in that said bag has:

(a) at least a pair of vertical slots in the outer one of said gusseted side walls adjacent one end closure, and (b) transverse perforations in the inner ply approximately mid-way along said slots, whereby said bag may be quickly opened by first tearing the outer wall along said slots, and then penetrating the inner ply through said transverse perforations to tear the corner of the bag, and to provide a pouring spout.

4. A multi-wall, heavy-duty, pinch seal bag according to claim 3, having an outer ply and at least two inner plies, with each of such inner plies having transverse perforations mid-way along the slots in said outer wall.

5. A multi-wall, heavy duty bag according to claim 1, wherein said slot is within an inwardly directed wall of said gusseted side walls.

6. A multi-wall, heavy duty bag according to claim 2, wherein said slots are within inwardly directed walls of said gusseted side walls.

7. A multi-wall, heavy duty bag according to claim 4, wherein said slots are within inwardly directed walls of said gusseted side walls.

* * * * *